US010622788B1

(12) United States Patent
Mixell et al.

(10) Patent No.: US 10,622,788 B1
(45) Date of Patent: Apr. 14, 2020

(54) CORONA IGNITION ASSEMBLY INCLUDING A HIGH VOLTAGE CONNECTION AND METHOD OF MANUFACTURING THE CORONA IGNITION ASSEMBLY

(71) Applicant: Tenneco Inc., Lake Forest, IL (US)

(72) Inventors: Kristapher I. Mixell, Plymouth, MI (US); Stefano Papi, Modena (IT); Marcello Cino, Carpi (IT); Massimo Augusto Dal Re, Concordia Sulla Secchia (IT); Danilo Giordano, Modena (IT)

(73) Assignee: Tenneco Inc., Lake Forest, IL (US)

( * ) Notice: Subject to any disclaimer, the term of this patent is extended or adjusted under 35 U.S.C. 154(b) by 0 days.

(21) Appl. No.: 16/218,934

(22) Filed: Dec. 13, 2018

(51) Int. Cl.

| | |
|---|---|
| ***H01T 13/06*** | (2006.01) |
| ***H01T 13/20*** | (2006.01) |
| ***H01T 21/02*** | (2006.01) |
| ***H01T 19/00*** | (2006.01) |

(52) U.S. Cl.
CPC ..... *H01T 13/06* (2013.01); *H01T 13/20* (2013.01); *H01T 19/00* (2013.01); *H01T 21/02* (2013.01)

(58) Field of Classification Search
CPC ..... H01T 13/06; H01T 19/00; H01T 13/20; H01T 21/02
See application file for complete search history.

(56) References Cited

U.S. PATENT DOCUMENTS

| | | | | |
|---|---|---|---|---|
| 2,833,950 | A | 5/1958 | Hastings, Jr. | |
| 4,764,703 | A | 8/1988 | Meyer | |
| 4,841,925 | A | 6/1989 | Ward | |
| 6,170,451 | B1 | 1/2001 | Moriya | |
| 6,206,709 | B1 | 3/2001 | Uchiyama | |
| 7,594,489 | B1 | 9/2009 | Marrs | |
| 7,777,401 | B2 | 8/2010 | Jaffrezic et al. | |
| 7,825,573 | B2 | 11/2010 | Callahan et al. | |
| 7,849,830 | B2 | 12/2010 | Maul et al. | |
| 8,151,781 | B2 | 4/2012 | Lykowski et al. | |
| 8,388,359 | B1 * | 3/2013 | Mahoney ..... | H01R 13/2464 439/125 |
| 8,474,428 | B2 | 7/2013 | Lykowski et al. | |
| 9,755,405 | B2 | 9/2017 | Mixell et al. | |

(Continued)

FOREIGN PATENT DOCUMENTS

WO 2017149430 A1 9/2017

*Primary Examiner* — Donald L Raleigh
(74) *Attorney, Agent, or Firm* — Robert L. Stearns; Dickinson Wright PLLC

(57) ABSTRACT

A corona ignition assembly including a firing end assembly and an ignition coil assembly connected by a high voltage connection is provided. The high voltage connection includes a high voltage insulator formed of silicon rubber. A shield formed of metal surrounds the high voltage insulator. The high voltage connection also includes an upper insert formed of metal connecting the shield to the ignition coil assembly and a lower insert formed of metal connecting the shield to the firing end assembly. First portions of the outer surface of the high voltage insulator adhere to the shield, the upper insert, and the lower insert, while second portions of the outer surface do not adhere to at least one of the shield, the upper insert, and the lower insert. A metal braid can be embedded in the high voltage insulator.

18 Claims, 6 Drawing Sheets

(56) References Cited

U.S. PATENT DOCUMENTS

| | | | | |
|---|---|---|---|---|
| 2011/0297116 | A1* | 12/2011 | Ruan | H01T 13/20<br>123/143 B |
| 2013/0049566 | A1* | 2/2013 | Burrows | F02P 23/04<br>313/141 |
| 2013/0340697 | A1* | 12/2013 | Burrows | H01T 13/50<br>123/146.5 R |
| 2014/0268480 | A1* | 9/2014 | Urciuoli | H01T 19/04<br>361/263 |
| 2014/0310947 | A1* | 10/2014 | Achtstatter | H01T 13/50<br>29/592.1 |
| 2015/0114332 | A1* | 4/2015 | Stifel | F02P 23/04<br>123/143 B |
| 2015/0200522 | A1* | 7/2015 | Stifel | H01T 13/08<br>361/263 |
| 2016/0039712 | A1* | 2/2016 | Firstenberg | C03C 8/18<br>313/141 |
| 2016/0049773 | A1* | 2/2016 | Stifel | F02P 23/04<br>361/230 |
| 2016/0285241 | A1* | 9/2016 | Sforzina | F02P 23/04 |
| 2016/0359301 | A1* | 12/2016 | Burrows | H01T 13/50 |
| 2016/0359302 | A1* | 12/2016 | Burrows | H01T 13/50 |
| 2017/0040776 | A1* | 2/2017 | Pottiez | H01T 19/00 |
| 2018/0026427 | A1* | 1/2018 | Bohne | F02P 13/00<br>313/134 |
| 2018/0274514 | A1* | 9/2018 | Mixell | F02P 23/04 |

* cited by examiner

CORONA IGNITION ASSEMBLY INCLUDING A HIGH VOLTAGE CONNECTION AND METHOD OF MANUFACTURING THE CORONA IGNITION ASSEMBLY

BACKGROUND OF THE INVENTION

1. Field of the Invention

This invention relates generally to corona ignition assemblies, and methods of manufacturing the corona ignition assemblies.

2. Related Art

Corona igniter assemblies for use in corona discharge ignition systems typically include an ignition coil assembly attached to a firing end assembly as a single component. The firing end assembly includes a center electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as non-thermal plasma. The ionized portion of the fuel-air mixture forms a flame front which then becomes self-sustaining and combusts the remaining portion of the fuel-air mixture. The electric field is also preferably controlled so that the fuel-air mixture does not lose all dielectric properties, which would create thermal plasma and an electric arc between the electrode and grounded cylinder walls, piston, or other portion of the igniter.

Ideally, the electric field is also controlled so that the corona discharge only forms at the firing end and not along other portions of the corona igniter assembly. However, such control is oftentimes difficult to achieve due to air gaps located between the components of the corona igniter assembly where unwanted corona discharge tends to form. For example, although the use of multiple insulators formed of different materials provides improved efficiency, robustness, and overall performance, the metallic shielding and the different electrical properties between the insulator materials leads to internal and interfacial stresses, an uneven electrical field, and air gaps at the interfaces. The dissimilar coefficients of thermal expansion and creep between the insulator materials can also lead to air gaps at the interfaces. During use of the corona igniter, the electrical field tends to concentrate in those air gaps, leading to unwanted corona discharge. Such corona discharge and the internal and interfaces stresses can cause material degradation and hinder the performance of the corona igniter assembly.

SUMMARY OF THE INVENTION

One aspect of the invention provides a corona ignition assembly comprising an igniter assembly including a firing end insulator surrounding an igniter central electrode, and an ignition coil assembly connected to the igniter assembly for conveying energy to the igniter central electrode. A high voltage connection connects the igniter assembly to the ignition coil assembly. The high voltage connection includes a high voltage insulator formed of silicon rubber and presenting an insulator outer surface. The high voltage connection also includes a shield formed of metal surrounding the high voltage insulator, an upper insert formed of metal connecting the shield to the ignition coil assembly, and a lower insert formed of metal connecting the shield to the firing end assembly. First portions of the insulator outer surface adhere to the shield, the upper insert, and the lower insert, and second portions of the insulator outer surface are not adhered to at least one of the shield, the upper insert, and the lower insert.

Another aspect of the invention provides a method of manufacturing a corona ignition assembly, comprising the steps of: providing an igniter assembly including a firing end insulator surrounding an igniter central electrode; and connecting the ignition coil assembly to the igniter assembly with a high voltage connection. The high voltage connection includes a high voltage insulator formed of silicon rubber, a shield formed of metal surrounding the high voltage insulator, an upper insert formed of metal connecting the shield to the ignition coil assembly, and a lower insert formed of metal connecting the shield to the firing end assembly. The high voltage insulator also presents an insulator outer surface, first portions of the insulator outer surface adhere to the shield, the upper insert, and the lower insert; and second portions of the insulator outer surface are not adhered to at least one of the shield, the upper insert, and the lower insert.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
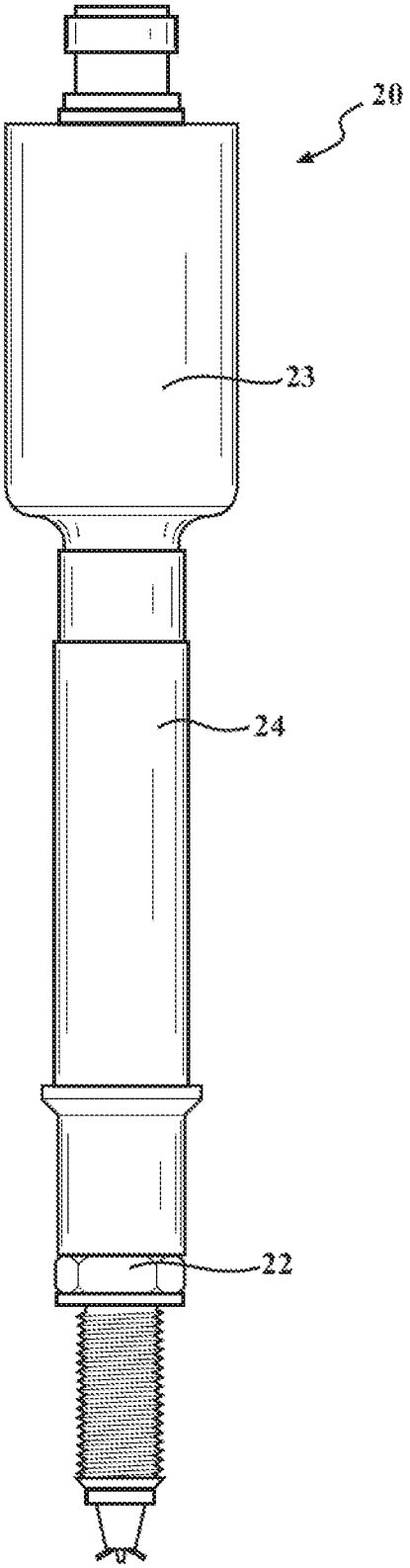
FIG. 1 illustrates a corona igniter assembly comprising a firing end assembly and an ignition coil assembly attached together by a high voltage connection.

A corona igniter assembly 20 for receiving a high radio frequency voltage and distributing a radio frequency electric field in a combustion chamber containing a mixture of fuel and gas to provide a corona discharge is generally shown in FIGS. 1-4A. As shown in FIG. 1, corona igniter assembly 20 includes a firing end assembly 22 connected to an ignition coil assembly 23 by a high voltage connection 24. The ignition coil assembly includes a coil which produces a high frequency and high voltage electric field, and the ignition coil assembly and the high voltage connection conveys the energy to the firing end assembly, which distributes this electric field in the combustion chamber for fuel ignition.

Figure 2:
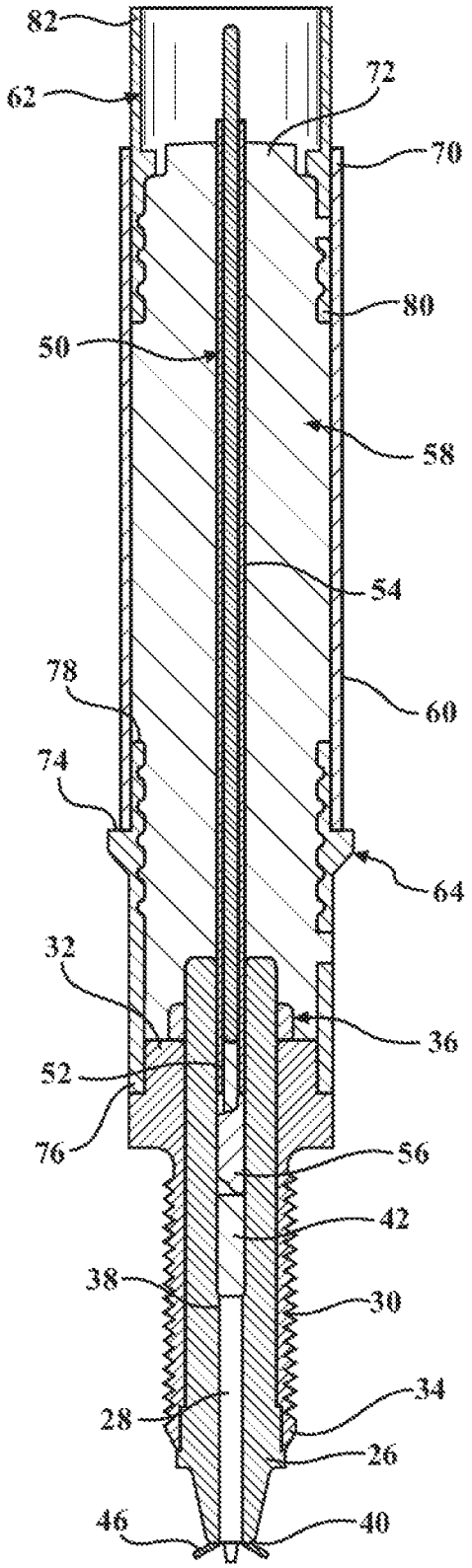
FIG. 2 is a cross-sectional view of the corona ignition assembly shown in FIG. 1.

As best shown in FIG. 2, the firing end assembly includes a firing end insulator 26 surrounding an igniter central electrode 28. The igniter central electrode receives the energy and distribute the energy in the combustion chamber. The firing end insulator is formed of a ceramic material, for example alumina, and presents a bore for receiving the igniter central electrode. The firing end assembly also includes a metal shell 30 surrounding the firing end insulator and extending longitudinally from a shell upper end 32 to a shell lower end 34.

The firing end assembly also including a ring 36 formed of a semi-conductive material disposed on the shell upper end and surrounding the firing end insulator. The igniter central electrode extends longitudinally along a center axis from a terminal end 38 to a firing end 40. An electrical terminal 42 is disposed on the terminal end of the igniter central electrode 44 and a firing tip 46 is disposed on the firing end of the igniter central electrode. The firing tip includes a plurality of branches extending radially outwardly relative to the center axis for distributing a radio frequency electric field.

As best shown in FIG. 2, a high voltage center electrode 50 formed of a conductive metal, for example brass, connects the electrical terminal to the ignition coil assembly. The high voltage center electrode is disposed on a spring 52 and thus is movable along the center axis and is able to float. A semi-conductive sleeve 54 formed of silicone surrounds the high voltage center electrode. The semi-conductive sleeve has a conductivity of greater than $1\times10^{-5}$ siemens/meter. A brass pack 56 is disposed on the electrical terminal in the bore of the firing end insulator, and the spring is disposed between the brass pack and the high voltage center electrode.

As shown in FIGS. 1 and 2, the high voltage connection which connects the firing end assembly to the ignition coil assembly includes a high voltage insulator 58 preferably formed of silicon rubber and a shield 60 formed of metal surrounding the high voltage insulator. The high voltage insulator is bonded to the semi-conductive sleeve, and the semi-conductive sleeve completely surrounds the high voltage center electrode. The high voltage insulator preferably has as a coefficient of thermal expansion ranging from 290 ppm/° C. to 315 ppm/° C. The high voltage connection can be flexible and can have various different dimensions and shapes, other than the shapes shown in the Figures, to fit various different engine geometries.

Figure 3:
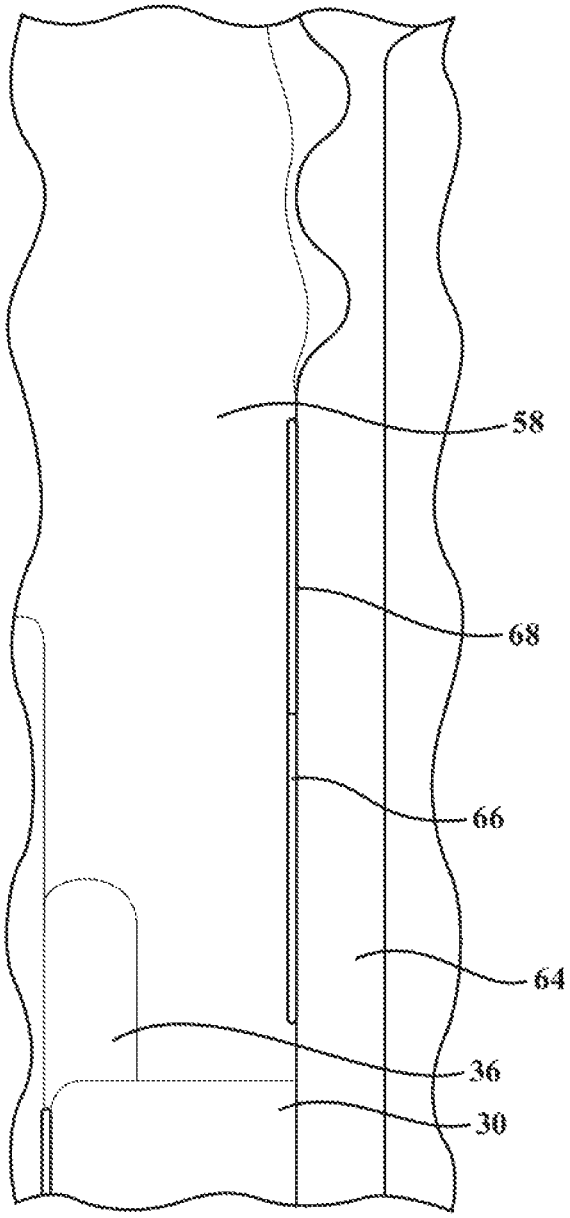
FIG. 3 is an enlarged view of a portion of the corona ignition assembly of FIG. 1 including the high voltage insulator and a lower insert.
Figure 4:
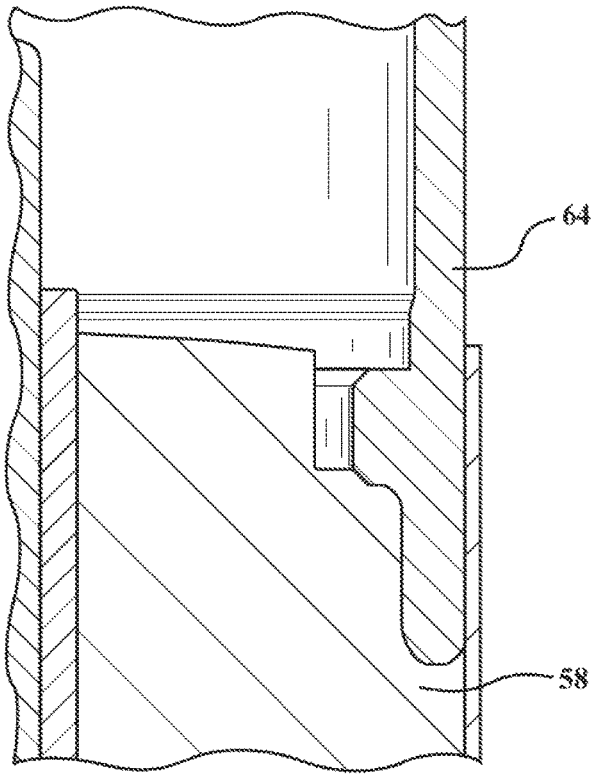
FIG. 4 is an enlarged view of a portion of the corona ignition assembly of FIG. 1 including the high voltage insulator adjacent the ignition coil assembly.
Figure 4A:
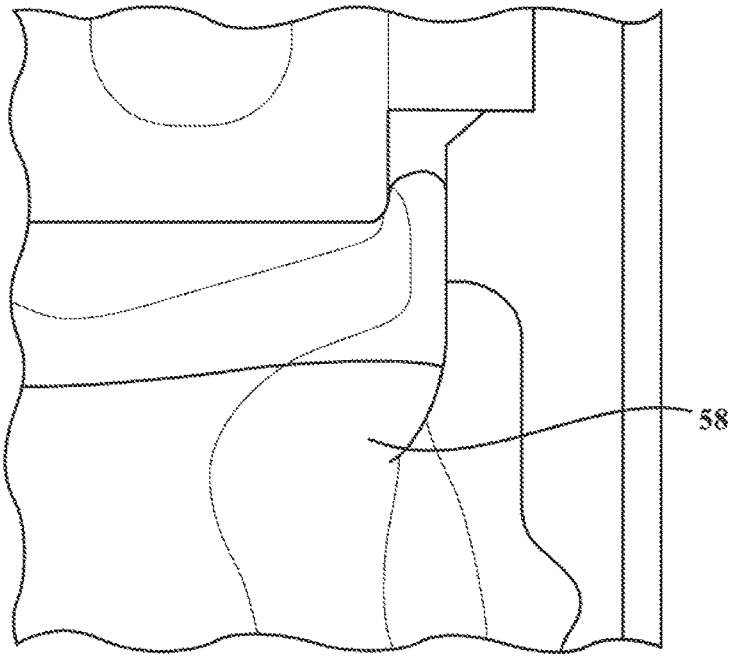
FIG. 4A is an enlarged view of a portion of FIG. 4 showing an expanded volume of the high voltage insulator after the high voltage insulator is exposed to a high temperature.
Figure 5:
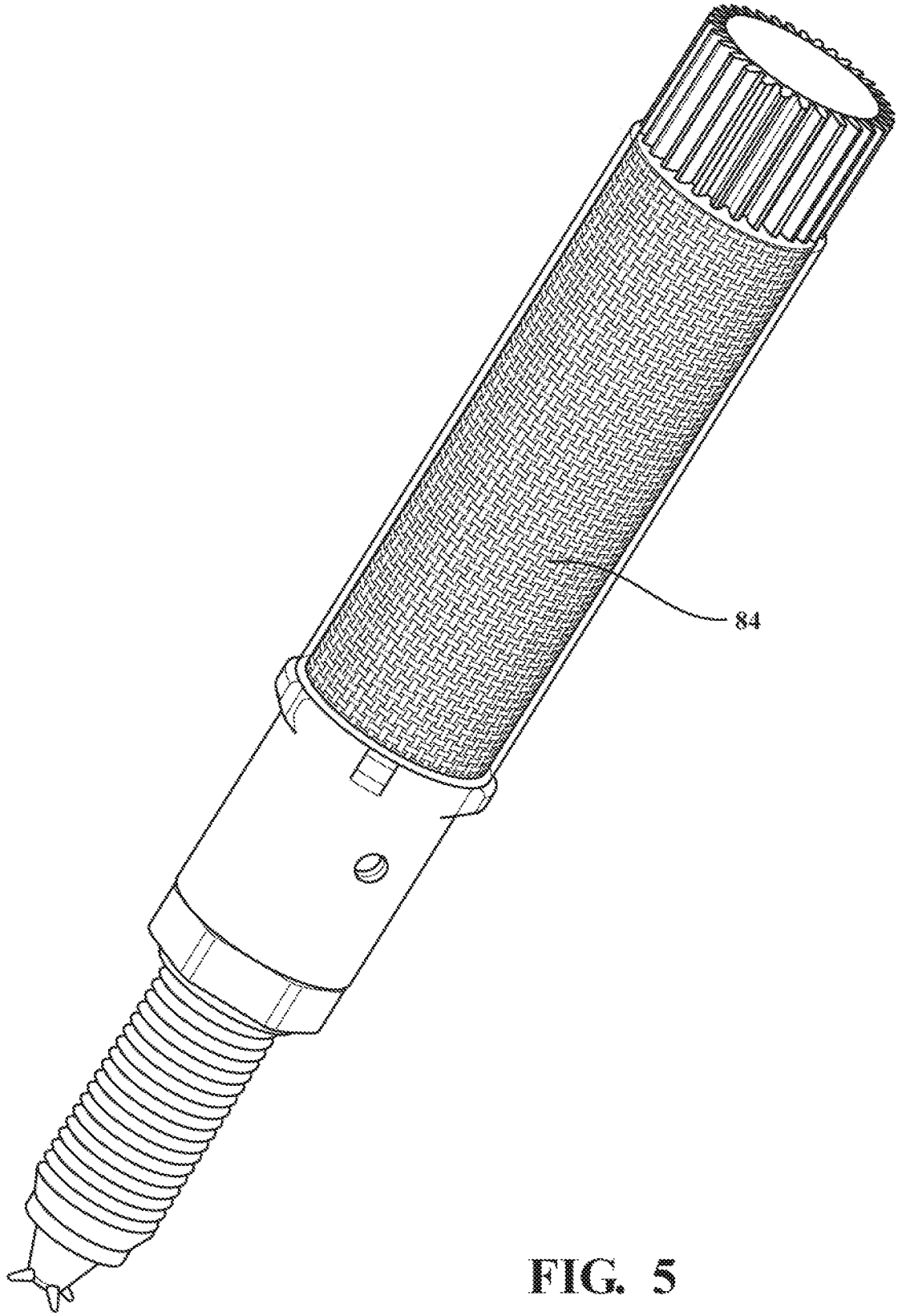
FIG. 5 is a perspective view of a corona ignition assembly which shows a metallic braid embedded in a high voltage insulator according to an example embodiment.
Figure 5A:
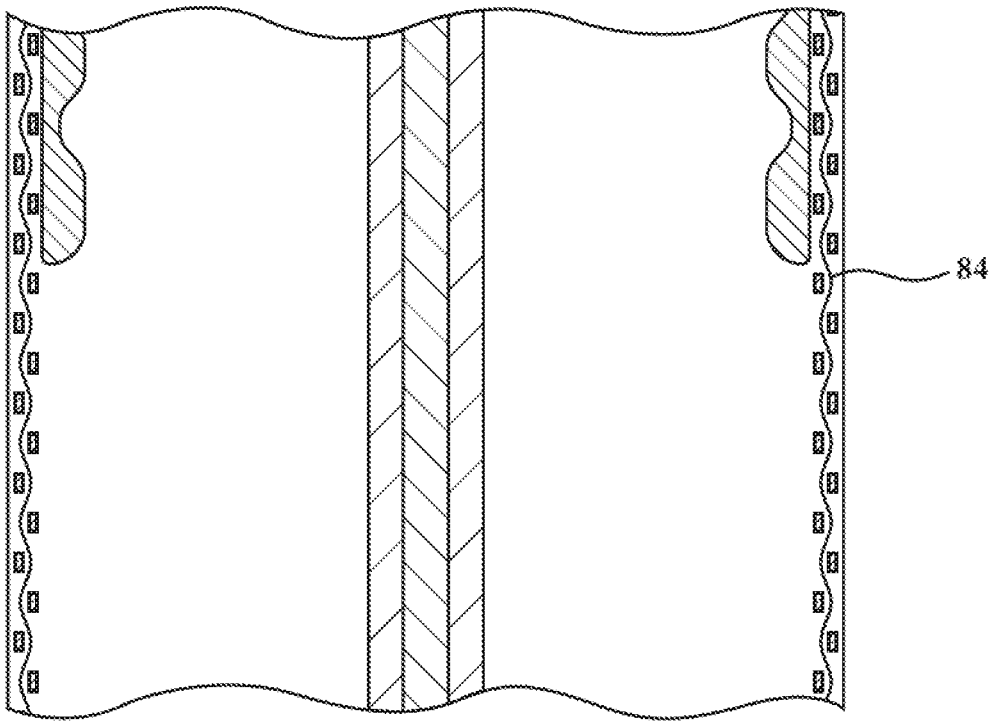
FIG. 5A is an enlarged view of a portion of the corona ignition assembly of FIG. 5 showing the metallic braid.

As shown in FIGS. 1 and 2, the high voltage insulator includes an upper insert 62 formed of metal connecting the shield to the ignition coil assembly and a lower insert 64 formed of metal connecting the shield to the firing end assembly. As shown in FIG. 3, the high voltage insulator presents and insulator outer surface, and first portions 66 of the insulator outer surface adhere to the shield, the upper insert, and the lower insert. However, second portions 68 of the insulator outer surface do not adhere to the shield, the upper insert, or lower insert in order to reduce stress on the high voltage insulator, for example when the high voltage insulator to expands during operation with exposure to high temperatures, as illustrated in FIGS. 4 and 4A. For example, the volume of the high voltage insulator can increase by 0.4 to 4% of the total volume of the high voltage insulator. According to an example embodiment, the silicone material of the high voltage insulator is a self-adhesive and thus the first portions adhere to the metal components. In this embodiment, the second portions of the outer surface are treated so that they do not adhere to the metal components. A braid 84 formed of metal is embedded in the high voltage insulator. An example of the braid is shown in FIGS. 5 and 5A. The braid realizes the ground connection between the upper and lower inserts.

As best shown in FIG. 2, the shield of the high voltage connection includes a shield upper end 70 engaging the upper insert and located adjacent an upper end 72 of the high voltage insulator. The shield extends longitudinally to a shield lower end 74 engaging the metallic lower insert. The lower insert includes a lower insert first end 76 engaging and disposed radially outwardly of the metal shell. The lower insert also includes a lower insert second end 78 disposed radially between the high voltage insulator and the metal shield. According to an example embodiment, the lower insert is welded to the metal shell. The upper insert of the high voltage connection includes an upper insert first end 80 disposed radially between the high voltage insulator and the shield, and an upper insert second end 82 engaging the ignition coil assembly. The high voltage connection further includes a layer of semiconductive silicone between the high voltage insulator and the shield, between the high voltage insulator and the lower insert and between the high voltage insulator the said upper insert. The high voltage connection may include gaps filled with air for containing portions of the high voltage insulator when the high voltage insulator expands during operation of the corona igniter assembly.

Another aspect of the invention provides a method of manufacturing a corona ignition assembly. The method includes providing the firing end assembly, and connecting the ignition coil assembly to the firing end assembly with the high voltage connection. The method also preferably includes embedding the braid formed of metal in the high voltage insulator, injecting the braid in the high voltage insulator, or casting the braid in the high voltage insulator, wherein the casting process is conducted in a vacuum.

The method can also include forming the high voltage insulator by injecting the silicone rubber at high pressure, with or without a vacuum, or casting the silicone rubber in a vacuum. The method also typically includes applying the layer of semiconductive silicone between the high voltage insulator and the shield, between the high voltage insulator and the lower insert, and between the high voltage insulator and the upper insert. According to one embodiment, the method includes welding the lower insert to the metal shell.

As indicated above, the design of the corona ignition assembly including the high voltage connection can provide several advantages. The high voltage insulator formed of silicone rubber provides flexibility, electric insulating, and resistance against the high temperature reached by the firing end assembly. The engine vibrations and working temperatures imply a mechanical constraint on the design of the assembly, due to the large thermal coefficient of thermal expansion of the silicone rubber. Preferably, the mechanical stress field on the high voltage insulator should be lower than critical material limit, for example the creep limit, of the silicone. The mechanical stress of the high voltage insulator in areas close to the ignition coil assembly and close to the firing end assembly should also be in a safe range. In these areas close to the ignition coil assembly and close to the firing end assembly, any dimensional variations as a function of temperature and external loads could introduce the wrong geometry of the joint in the electrical connections if not compensated. A similar condition will cause a failure of the system due to a low contact pressure in the high voltage joints. This kind of condition increases the possibility to create partial discharges between the components of the joint itself. One of the advantages of the high voltage connection design is that it controls the thermal expansion and shrinkage of the high voltage insulator in order to reduce internal stress and interface stress to values under the limits of the materials. More specifically, due to the design of the corona igniter assembly, an internal degree of freedom is present between the two metallic inserts and two external degrees of freedom (vertical/axial) are present with respect to the frame/engine.

As explained above, the semiconductive sleeve surrounding the high voltage center electrode provides the advantage of mitigating the electrical field. The electric field peak located in the transition between ceramic and metallic components of the firing end assembly are mitigated by the semiconductive sleeve. The shield on the external surface of the high voltage insulator suppresses the electromagnetic noises generated by a high frequency and high voltage signal. This metallic shield is also used to increase the torque strength of the high voltage connection during the coil fitting operation on the high voltage connection sub-assembly itself. Due to the shield, the "z", the radial "x", and the radial "y" degrees of freedom are avoided in order to not overly stress the high voltage insulator during the temperature changes. To avoid the degrees of freedom, the metal shield is generally realized as a rigid component, while the semiconductive sleeve is interposed between the high voltage insulator and the metal shield itself to avoid partial discharge on this internal interface.

The mechanical stresses inside the high voltage connection and on the interfaces between the high voltage connection and the ignition coil assembly, as well as between the high voltage connection and the firing end assembly, are controlled by the design of the interfaces, as well as by the defined distribution of the bonded and not bonded areas of the high voltage insulator with the other components. This design avoids an initial mechanical pre-stress on the silicon rubber of the high voltage insulator during a post process vulcanization. The high voltage insulator can be formed of self-adhesive silicone to provide the required bond strength in the areas where bonding is required during the vulcanization process. For not bonded areas, however, specific surface treatments are typically conducted on the high voltage insulator.

Preferably, near the interface between the ignition coil assembly and the high voltage connection, a specific expansion volume for the high voltage insulator is provided to reduce stresses evaluated on the materials of the joint and the consequent creep issue. FIGS. 4 and 4A illustrate the high voltage insulator before and after expanding. Moreover, location and geometries of those expansion volumes are defined in order to get a value for the electric field inside such volumes lower than the inception voltage of air in all temperature ranges and at the highest output voltage of the corona ignition system.

In addition, the reliability of the electrical connection during thermal expansion is realized by the floating high voltage central electrode, which connects an output of the ignition coil assembly to the firing end assembly. The floating high voltage center electrode is able to slide and is assembled inside the semiconductive sleeve, which can be bonded to the self-adhesive silicone of the high voltage insulator. The conductivity of the semiconductive sleeve is preferably higher than $1\times10^{-5}$ Siemens/meter to avoid corona formation at the external surface of the high voltage center electrode.

According to a preferred embodiment, the metallic braid is embedded in the high voltage insulator to shield the high voltage insulator. The metallic braid can be embedded in the silicone body by the impregnation process, for example high pressure injection, silicone vacuum casting, or other similar technologies that can provide an insulating silicone co-molding of the parts. The metal shield around the high voltage insulator is connected to the inserts, which are connected to the high voltage insulator, typically by adhesion. The lower insert is preferably fixed on the metal shell of the corona igniter assembly by laser welding or a similar technology system and has a particular shape to allow for installation in the corona ignition system. The upper and lower inserts provide mechanical strength to the connections of the high voltage connection to the firing end assembly and ignition coil assembly. The non-bonded areas of the high voltage insulator inside the inserts and the expansion volume provided in the assembly controls the thermal expansion and the mechanical stress of the high voltage insulator. The semiconductive ring, which is preferably formed of silicone, on the interface between the high voltage insulator and the firing end assembly provides for electric field stress grading close to the critical interface.

Another advantage is that the high voltage insulator can be formed by a single operation, for example injection molding, or vacuum casting, or other similar technology, with all components in place, thus avoiding additional assembly procedures, and which guarantees reliability and repeatability of the bonding properties in the interfaces. The use of self-adhesive silicon rubber for the high voltage insulator improves the insulation properties of the interfaces, compared to silicone glue. In addition, parts of the corona ignition assembly can be comolded together in place, which provides the possibility for a clean and stable process. If an air free process, such as vacuum casting or injection molding under a vacuum is conducted, the possibility of having air trapped inside the assembly along critical interfaces is reduced.

Obviously, many modifications and variations of the present invention are possible in light of the above teachings and may be practiced otherwise than as specifically described while within the scope of the claims. It is contemplated that all features described and of all embodiments can be combined with each other, so long as such combinations would not contradict one another.

The invention claimed is:

1. A corona ignition assembly, comprising:

a firing end assembly including a firing end insulator surrounding an igniter central electrode;

an ignition coil assembly connected to said firing end assembly for conveying energy to said igniter central electrode;

a high voltage connection connecting said firing end assembly to said ignition coil assembly;

said high voltage connection including a high voltage insulator formed of silicon rubber and presenting an insulator outer surface;

said high voltage connection including a shield formed of metal surrounding said high voltage insulator;

said high voltage connection including an upper insert formed of metal connecting said shield to said ignition coil assembly and a lower insert formed of metal connecting said shield to said firing end assembly;

a braid formed of metal embedded in said high voltage insulator;

first portions of said insulator outer surface adhering to said shield, said upper insert, and said lower insert; and second portions of said insulator outer surface being not adhered to at least one of said shield, said upper insert, and said lower insert.

2. A corona igniter according to claim 1, wherein said shield includes a shield upper end engaging said metallic upper insert and extending longitudinally to a shield lower end engaging said metallic lower insert.

3. A corona igniter according to claim 1, wherein said firing end assembly includes a metal shell surrounding said firing end insulator, said lower insert includes a lower insert first end engaging and disposed radially outwardly of said metal shell, and said lower insert includes a lower insert second end disposed radially between said high voltage insulator and said metal shield.

4. A corona igniter according to claim 1, wherein said lower insert is welded to said metal shell.

5. A corona igniter assembly according to claim 1 including a firing tip is disposed on a firing end of said igniter central electrode, said firing tip including a plurality of branches extending radially outwardly relative to a center axis for distributing a radio frequency electric field.

6. A corona igniter assembly according to claim 1, wherein said firing end assembly includes a spring between said igniter central electrode and a high voltage center electrode.

7. A corona igniter assembly according to claim 1, wherein said central electrode extends longitudinally along a center axis from a terminal end to a firing end, and said central electrode is movable along said center axis.

8. A corona igniter assembly according to claim 1, wherein said firing end insulator is formed of a ceramic material and presents a bore for receiving said igniter central electrode;

wherein said firing end assembly includes a metal shell surrounding said firing end insulator and extending longitudinally from a shell upper end to a shell lower end;

said firing end assembly including a ring formed of a semi-conductive material disposed on said shell upper end and surrounding said firing end insulator;

said igniter central electrode extends longitudinally along said center axis from a terminal end to a firing end;

said firing end assembly includes an electrical terminal disposed on said terminal end of said igniter central electrode and a firing tip disposed on said firing end of said igniter central electrode;

said firing tip includes a plurality of branches extending radially outwardly relative to said center axis for distributing a radio frequency electric field;

said firing end assembly includes a brass pack disposed on said electrical terminal in said bore of said firing end insulator;

said firing end assembly includes a spring disposed between said brass pack and a high voltage center electrode;

said high voltage center electrode is formed of a conductive metal and is disposed on said spring;

said high voltage center electrode connects said electrical terminal to said ignition coil assembly;

said high voltage connection includes a semi-conductive sleeve formed of silicone surrounding said high voltage center electrode and bonded to said high voltage insulator;

said semi-conductive sleeve having a conductivity of greater than $1\times10^{-5}$ siemens/meter;

said high voltage insulator surrounds said semi-conductive sleeve;

said high voltage insulator has a coefficient of thermal expansion ranging from 290 ppm/° C. to 315 ppm/° C.;

said shield includes a shield upper end engaging said upper insert and located adjacent an upper end of said high voltage insulator and extending longitudinally to a shield lower end engaging said metallic lower insert;

said lower insert includes a lower insert first end engaging and disposed radially outwardly of said metal shell and a lower insert second end disposed radially between said high voltage insulator and said metal shield;

said lower insert is welded to said metal shell;

said upper insert includes an upper insert first end disposed radially between said high voltage insulator and said shield and an upper insert second end engaging said ignition coil assembly;

said high voltage connection including a layer of semi-conductive silicone between said high voltage insulator and said shield, between said high voltage insulator and said lower insert and between said high voltage insulator and said upper insert;

said high voltage connection includes gaps filled with air for containing portions of said high voltage insulator when said high voltage insulator expands during operation of said corona igniter assembly.

9. A corona igniter according to claim 1, comprising:

a firing end assembly including a firing end insulator surrounding an igniter central electrode;

an ignition coil assembly connected to said firing end assembly for conveying energy to said igniter central electrode;

a high voltage connection connecting said firing end assembly to said ignition coil assembly;

said high voltage connection including a high voltage insulator formed of silicon rubber and presenting an insulator outer surface;

said high voltage connection including a shield formed of metal surrounding said high voltage insulator;

said high voltage connection including an upper insert formed of metal connecting said shield to said ignition coil assembly and a lower insert formed of metal connecting said shield to said firing end assembly;

first portions of said insulator outer surface adhering to said shield, said upper insert, and said lower insert; and second portions of said insulator outer surface being not adhered to at least one of said shield, said upper insert, and said lower insert;

wherein said upper insert includes an upper insert first end disposed radially between said high voltage insulator and said shield, and said upper insert includes an upper insert second end engaging said ignition coil assembly.

10. A corona igniter comprising:

a firing end assembly including a firing end insulator surrounding an igniter central electrode;

an ignition coil assembly connected to said firing end assembly for conveying energy to said igniter central electrode;

a high voltage connection connecting said firing end assembly to said ignition coil assembly;

said high voltage connection including a high voltage insulator formed of silicon rubber and presenting an insulator outer surface;

said high voltage connection including a shield formed of metal surrounding said high voltage insulator;

said high voltage connection including an upper insert formed of metal connecting said shield to said ignition coil assembly and a lower insert formed of metal connecting said shield to said firing end assembly;

first portions of said insulator outer surface adhering to said shield, said upper insert, and said lower insert; and second portions of said insulator outer surface being not adhered to at least one of said shield, said upper insert, and said lower insert;

wherein said high voltage connection includes a layer of semiconductive silicone between said high voltage insulator and said shield, between said high voltage insulator and said lower insert, and between said high voltage insulator and said upper insert.

11. A corona igniter comprising:

a firing end assembly including a firing end insulator surrounding an igniter central electrode;

an ignition coil assembly connected to said firing end assembly for conveying energy to said igniter central electrode;

a high voltage connection connecting said firing end assembly to said ignition coil assembly;

said high voltage connection including a high voltage insulator formed of silicon rubber and presenting an insulator outer surface;

said high voltage connection including a shield formed of metal surrounding said high voltage insulator;

said high voltage connection including an upper insert formed of metal connecting said shield to said ignition coil assembly and a lower insert formed of metal connecting said shield to said firing end assembly;

first portions of said insulator outer surface adhering to said shield, said upper insert, and said lower insert; and second portions of said insulator outer surface being not adhered to at least one of said shield, said upper insert, and said lower insert;

wherein said firing end assembly includes a metal shell surrounding said firing end insulator and extending longitudinally from a shell upper end to a shell lower end, and said firing end assembly including a ring formed of a semi-conductive material disposed on said shell upper end and surrounding said firing end insulator.

12. A method of manufacturing a corona ignition assembly, comprising the steps of:

providing a firing end assembly including a firing end insulator surrounding an igniter central electrode;

connecting the ignition coil assembly to the igniter assembly with a high voltage connection; the high voltage connection including a high voltage insulator formed of silicon rubber and a shield formed of metal surrounding the high voltage insulator; the high voltage connection including an upper insert formed of metal connecting the shield to the ignition coil assembly and a lower insert formed of metal connecting the shield to the firing end assembly;

the high voltage insulator presenting an insulator outer surface; first portions of the insulator outer surface adhering to the shield, the upper insert, and the lower insert; and second portions of the insulator outer surface being not adhered to at least one of the shield, the upper insert, and the lower insert; and embedding a braid formed of metal in the high voltage insulator.

13. A method according to claim 12 including injecting the braid in the high voltage insulator or casting the braid in the high voltage insulator, the casting process being conducted in a vacuum.

14. A method of manufacturing a corona ignition assembly, comprising the steps of:

providing a firing end assembly including a firing end insulator surrounding an igniter central electrode;

connecting the ignition coil assembly to the igniter assembly with a high voltage connection; the high voltage connection including a high voltage insulator formed of silicon rubber and a shield formed of metal surrounding the high voltage insulator; the high voltage connection including an upper insert formed of metal connecting the shield to the ignition coil assembly and a lower insert formed of metal connecting the shield to the firing end assembly;

the high voltage insulator presenting an insulator outer surface; first portions of the insulator outer surface adhering to the shield, the upper insert, and the lower insert; and second portions of the insulator outer surface being not adhered to at least one of the shield, the upper insert, and the lower insert; and wherein the shield includes a shield upper end engaging the metallic upper insert and extending longitudinally to a shield lower end engaging the metallic lower insert, the firing end assembly includes a metal shell surrounding the firing end insulator, the lower insert includes a lower insert first end engaging and disposed radially outwardly of the metal shell, the lower insert includes a lower insert second end disposed radially between the high voltage insulator and the shield, the upper insert includes an upper insert first end disposed radially between the high voltage insulator and the shield, and the upper insert includes an upper insert second end engaging the ignition coil assembly.

15. A method according to claim 12 including forming the high voltage insulator by injecting the silicone rubber or casting the silicone rubber in a vacuum.

16. A method according to claim 12, wherein the firing end assembly includes a metal shell and including the step of welding the lower insert to the metal shell.

17. A method according to claim 12, wherein a firing tip is disposed on a firing end of the igniter central electrode, and the firing tip includes a plurality of branches extending radially outwardly relative to the center axis for distributing a radio frequency electric field.

18. A method of manufacturing a corona ignition assembly, comprising the steps of:

providing a firing end assembly including a firing end insulator surrounding an igniter central electrode;

connecting the ignition coil assembly to the igniter assembly with a high voltage connection; the high voltage connection including a high voltage insulator formed of silicon rubber and a shield formed of metal surrounding the high voltage insulator; the high voltage connection including an upper insert formed of metal connecting the shield to the ignition coil assembly and a lower insert formed of metal connecting the shield to the firing end assembly;

the high voltage insulator presenting an insulator outer surface; first portions of the insulator outer surface adhering to the shield, the upper insert, and the lower insert; and second portions of the insulator outer surface being not adhered to at least one of the shield, the upper insert, and the lower insert; and including applying a layer of semiconductive silicone between the high voltage insulator and the shield, between the high voltage insulator and the lower insert, and between the high voltage insulator and the upper insert.

* * * * *